United States Patent [19]

Clavin

[11] 4,027,349

[45] June 7, 1977

[54] APPARATUS FOR BRUSH-CLEANING THE INTERIORS OF PIPES

[75] Inventor: Edward Albert Clavin, Houston, Tex.

[73] Assignee: Midcon Pipeline Equipment Co., Houston, Tex.

[22] Filed: Mar. 12, 1976

[21] Appl. No.: 619,702

[52] U.S. Cl. ..... 15/104.12; 15/88; 118/72

[51] Int. Cl.[2] ..... B08B 9/02

[58] Field of Search .... 15/104.05, 104.09, 104.1 R, 15/104.12, 88; 118/72, 105, 215, 254, 306, 317, DIG. 10

[56] References Cited

UNITED STATES PATENTS

| | | | |
|---|---|---|---|
| 2,017,042 | 10/1935 | Dougherty | 118/105 |
| 2,998,800 | 9/1961 | VerNooy | 118/306 X |
| 3,004,278 | 10/1961 | Stanley | 15/104.09 X |
| 3,078,823 | 2/1963 | Cummings et al. | 15/104.09 X |
| 3,106,491 | 10/1963 | Leibner | 118/72 X |
| 3,448,474 | 6/1969 | Goodrum | 15/104.09 X |
| 3,905,061 | 9/1975 | Cradeur | 15/104.05 X |

*Primary Examiner*—Edward L. Roberts
*Attorney, Agent, or Firm*—Carl B. Fox, Jr.

[57] ABSTRACT

Apparatus for brush-cleaning the interiors of pipes, wherein rotative brushes are carried by a rotative carrier plate. The brushes are rotated by air motors, and rotate at very high speeds. The brushes are spring-loaded to consistently bear against the inside of the pipe wall, and are disposed at a small angle from radial which results in reduced brush wear and more efficient pipe wall cleaning.

31 Claims, 6 Drawing Figures

Fig. 5
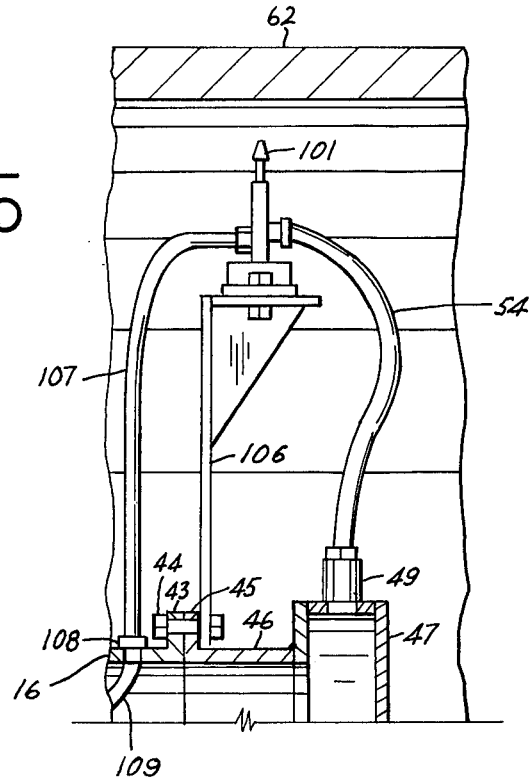
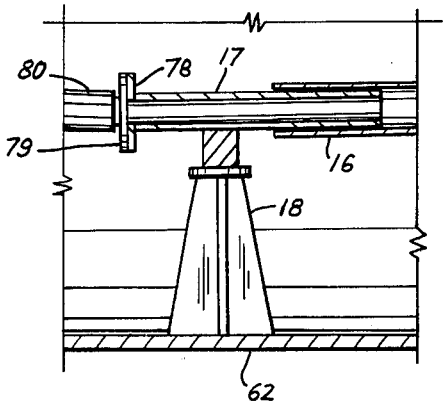
Fig. 6

APPARATUS FOR BRUSH-CLEANING THE INTERIORS OF PIPES

BACKGROUND OF THE INVENTION

The cleaning of the interior of pipes is a very difficult job. Many types of equipment have been developed for this purpose, but none is entirely satisfactory. Apparatuses using scrapers invariably do an incomplete cleaning job. Apparatuses heretofore developed which use brushes may do a more complete cleaning job than the scraper apparatuses, but generally brush wear is high and the cleaning is not completely satisfactory.

SUMMARY OF THE INVENTION

The invention provides an apparatus for brush-cleaning the interior walls of pipes wherein peripherially disposed brushes are provided which rotate at very high rotational speeds. The brushes, which themselves rotate, are rotated about the periphery of the pipe and a very satisfactory cleaning of the pipe wall interior is obtained. The apparatus is adapted to travel along the length of the pipe, so that cleaning of the interior wall of the pipe may be done over the full length of the pipe. The brushes are rotated by pneumatic air motors, and the exhaust air from the air motors is utilized to carry the material loosened from the pipe wall out of the pipe. The apparatus may be self contained or may receive the air necessary for rotation of the brushes from an exterior source.

A principal object of the invention is to provide improved apparatus for brush-cleaning the interior walls of pipes. A further object of the invention is to provide such apparatus which is simple, and which is entirely reliable and safe in use. Another object of the invention is to provide such apparatus which is adapted to move through the length of a pipe. A further object of the invention is to provide such apparatus which has brushes which rotates at extremely high speeds and which therefore perform a superior cleaning job on the walls of the pipe.

Other objects and advantages of the invention will appear from the following detailed description of the preferred embodiments, reference being made to the accompanying drawings.

BRIEF DESCRIPTIONS OF THE DRAWINGS

FIG. 5 is a partial view showing a modified form of the apparatus.

FIG. 6 is a partial view showing another modified form of the apparatus.

DESCRIPTION OF THE PREFERRED EMBODIMENTS

Figure 1:
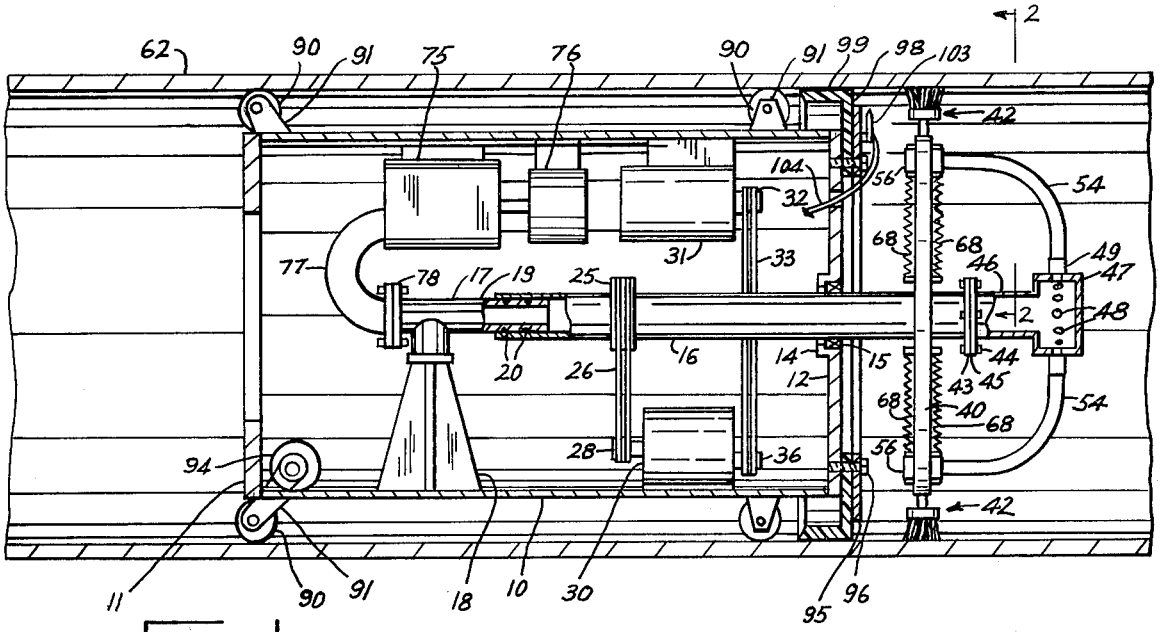
FIG. 1 is an axial cross section showing an apparatus of preferred form according to the invention disposed in a pipe.

Referring now to the drawings in detail, showing preferred embodiments of the apparatus according to the invention, and first to FIG. 1, the apparatus has a housing or body 10 which may be formed of a length of pipe, or may be otherwise suitably constructed to carry the apparatus elements. A ring shaped annular plate 11 partially closes and supports one end of housing 10. A plate 12 closes the opposite end of housing 10. Plate 12 has a central concentric offset 14 supporting a bearing 15. A pipe 16 is rotatively disposed through bearing 15. The left-hand end of pipe 16, as shown in FIG. 1, is supported by support element 17 which is supported by a suitable pedestal 18 carried by the wall of housing 10.

Pipe 16 rotates on the right-hand tubular portion 19 of element 17, a rotative seal being formed by O-rings 20 disposed in suitable grooves around element 19. Other suitable forms of seals may be used. A sheave 25 is fixed of pipe 16, belts 26 around sheave 25 being engaged also around a smaller sheave 28 mounted on the shaft of a gear box 30. Gear box 30 is driven by an electric motor 31 having sheave 32 disposed on its shaft, belts 33 therearound being engaged around a sheave 36 of gear box 30. The gear box and belt drives are preferably adapted to rotate pipe 16 at about 105 revolutions per minute, although different rotational speeds, either higher or lower, may be used.

A generally circular plate 40 has a central opening welded around pipe 16, and rotates with pipe 16. Referring now also to the other drawing figures, plate 40 carries a plurality of rotative brush assemblies 42, twelve brush assemblies being indicated in the drawings, but any suitable number thereof being comtemplated by the invention. Only two of the brush assemblies 42 are shown in FIG. 1.

Pipe 16, as shown in FIG. 1, has a flange 43 around its right hand end. Flange 43 is bolted by plural bolts 44 to flange 45 of pipe extension 46. Pipe extension 46 has an enlarged cylindrical box 47 at its end in flow communication therewith. A plurality of outlets 49 are provided around the periphery of box 47, equally circularly spaced, the outlets being of the same number as the brush assemblies 42. An interiorly threaded coupling 49 is welded to the exterior of box 47 around each of the outlets 48. A hose coupling 53 is screwed into each coupling 49 to connect a hose 54 to each outlet 48. Each hose 54 is coupled to a hose connection 55 of a pneumatic air motor 56. Shaft 58 of each air motor carries a rotative brush 59 having bristles 60 in engagement with the inner side of the wall of a pipe 62 within which the apparatus is disposed.

Figure 4:
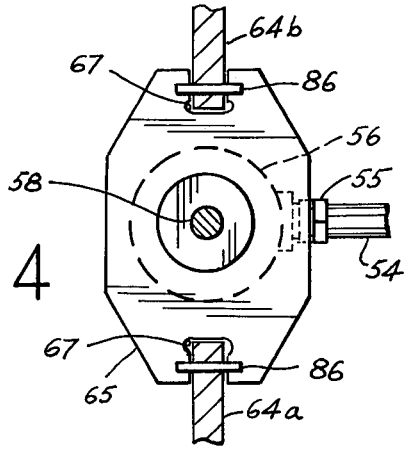
FIG. 4 is a partial view taken at line 4—4 of FIG. 3.

The plate 40 has around its periphery a plurality of equally circularly spaced generally rectangular recesses 64. The recesses 64 are each at a slight angle, say about 3° or other suitable small angle, to a radius of plate 40. Each air motor 56 is affixed to a pair of parallel plates 65, 66, which are beveled at their corners as indicated best in FIG. 4. The plates 65, 66 each have slots 67 at opposite ends thereof which closely but slidably receive the opposite sides 64*a*, 64*b* of the slots 64. At opposite sides of each air motor 56 compression springs 68 are disposed compressively disposed between plates 66 and support brackets 71 welded to plate 40. The springs 68 urge the air motors 56 outwardly in slots 64, to urge the bristles 60 of brushes 69 firmly against the inner side of the pipe wall.

A compressor 75 driven by electric motor 76 delivers air through hose 77 connected to flange 78 of support element 17. The air delivered by pump 75 passes through element 17 and pipe 16 to box 47, wherefrom the air flows through hoses 54 to the plural air motors 56. The air motors rotate the brushes 59 at relatively high speeds, preferably about 6,000 revolutions per minute or even higher. The brushes therefore effectively scour the inside of the wall of the pipe. Since the plate 40 is rotating with pipe 16, the brushes are carried spirally peripherally around the inner pipe wall as the apparatus travels through the pipe.

Alternatively, as shown in FIG. 6, connection flange 78 of element 17 may be connected to flange coupling 79 connected to an air or gas hose or line 80 extending through the pipe from an exterior compressor which delivers pressured air or other suitable gas to pipe 16 and air motors 56. In this case, the pump 75 and motor 76 would be unnecessary.

Figure 2:
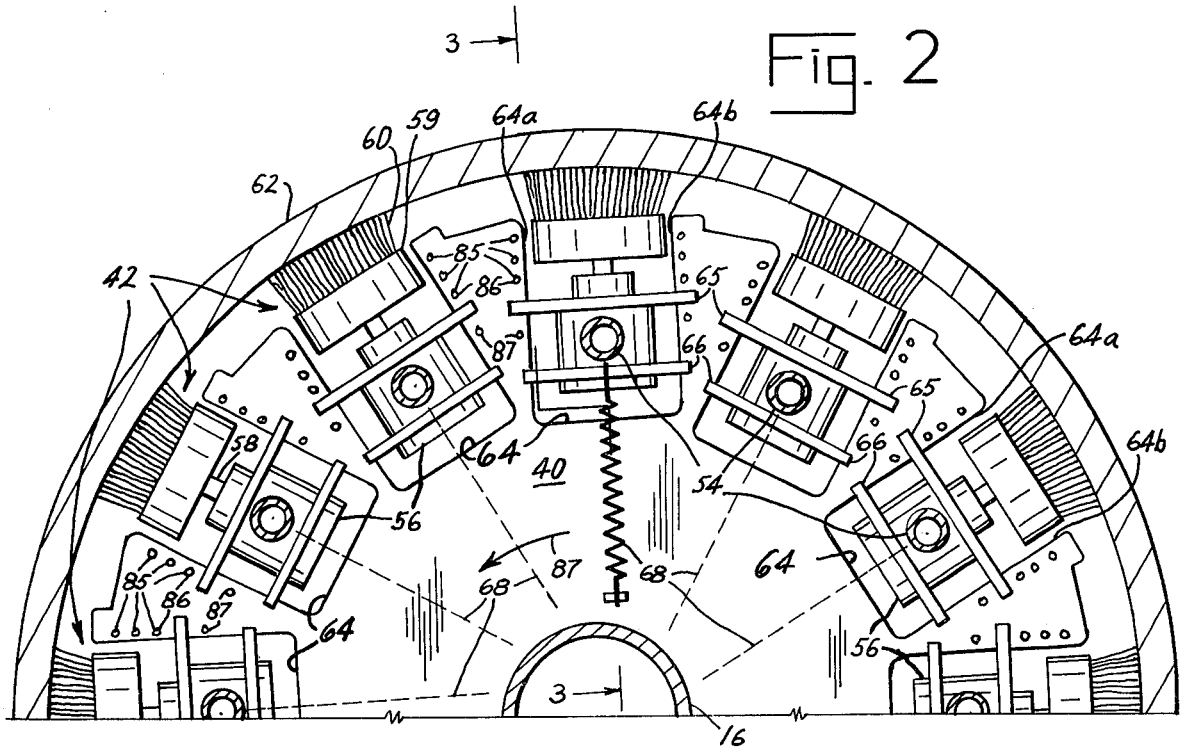
FIG. 2 is a transverse half section taken at line 2—2 of FIG. 1.
Figure 3:
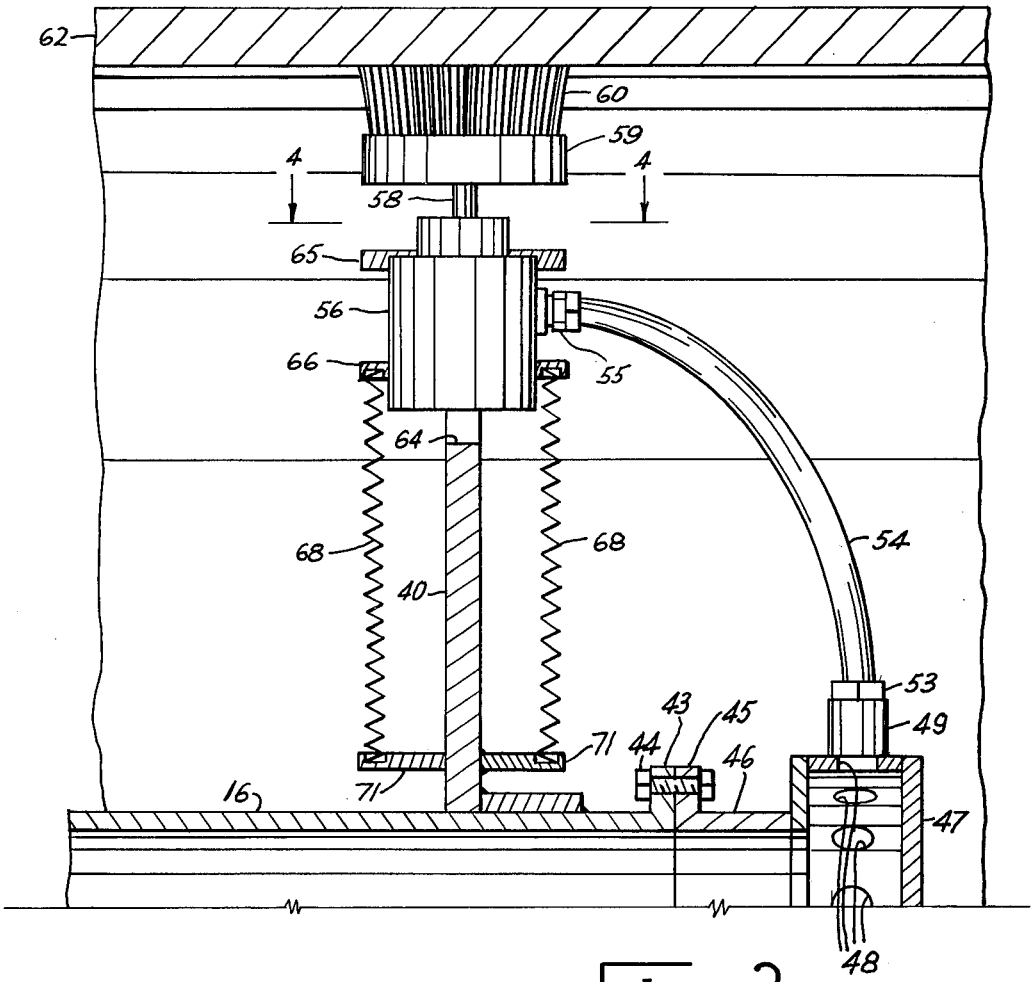
FIG. 3 is a partial view showing one of the brush assemblies of the apparatus shown in FIGS. 1–2, taken at line 3—3 of FIG. 2.

As mentioned earlier, the motors 56 and brushes 59 are disposed at a small angle to radial with regard to plate 40. Plate 40 and brushes 59 rotate in the direction indicated by arrow 82 shown in FIG. 2. With regard to the rotation of plate 40 and brushes 59, the leading edges of the brushes 59 are in less firm contact with the pipe wall than their trailing edges. This disposition of the brushes prevents distortion and damage to the bristles 60 at the leading brush edges, so that the brushes are insured of longer useful life.

At each side of each recess 64, there are provided a plurality of holes 85 parallel with the opposite sides of the slot 64. Pins 86 limit the outward travel of gas motors 56 and brushes 59, plates 65 engaging the pins and limiting outward brush travel. Inwardly of each plate 65, similar pins 87 through suitable openings through plate 40 limit inward movement of the gas motors 56 and brushes 59. As brush wear occurs, the pin 86 may be moved to the outer openings 85 to permit further outward brush travel.

Housing 10 is supported by a plurality of wheels 90 supported to housing 10 by bracker supports 91. One or more of the wheels 90 may be driven by a drive motor 94 mounted within housing 10. Motor 94 may be a hydraulic or pneumatic motor, or may be an electric motor. The usual direction of movement of housing 10, FIG. 1, is toward the right. At the leading end of housing 10, an annular ring shaped plate 95 is bolted by bolts 96 to plate 12. An annular element 98 of elastomeric material is fixed beneath plate 95, and has an L-shaped annular cross section as shown, the outer flange 99 thereof being engagement with the interior pipe wall. As housing 10 travels toward the right, as shown in FIG. 1, the element 98 serves as a scraper element to scrape loose material from the pipe wall, the loose material having resulted from the operation of brushes 59. The air emitted by air motors 56 travels out of the pipe toward the right, as shown in FIG. 1, and serves to carry a substantial amount of the material brushed from the pipe wall out of the pipe.

As indicated in FIG. 5, the apparatus may be used for painting the interior walls of pipes. Paint sprayer 101 connected to an air outlet 49 by hoses 54 will effectively spray paint the interior pipe wall. Any suitable number of sprayers 101 may be provided, the unused outlets 49 being plugged. The element 98 may be removed. Each sprayer 101 is supported by a stand 106 bolted beneath the head of a bolt 44. A hose or tube 107 extends to the sprayer from a connection 108 through the wall of pipe 16, a pipe or tube 109 extending through pipe 16 to connection 108. The other end of pipe or tube 109 (not shown) is connected by a swivel connection to another pipe or tube from a paint supply which may be carried by housing 10 or may lead through pipe 62 to an exterior supply. Paint flows to sprayer 101 through these conduits, and air from hose 54 is used to spray paint the inner side of the pipe wall.

A solvent or water wash may be injected into the pipe at nozzles 103, one being shown, any number of which may be connected to plate 95 around the leading end of the apparatus. A hose 104 through a suitable opening through plate 12 supplies liquid to nozzle 103 from a suitable source, not shown. Alternatively, a solvent or water wash may be injected with the incoming air to be emitted through the brushes to perform a more complete washing operation. The solvent or water wash will help prevent the brushed off material from re-sticking to the pipe.

While preferred embodiments of the apparatus have been described and shown in the drawings, many modifications thereof may be made by a person skilled in the art without departing from the spirit of the invention, and it is intended to protect by Letters Patent all forms of the invention falling within the scope of the following claims.

I claim:

1. Apparatus for brush cleaning the inner side of the wall of a pipe, comprising body means adapted to be received in a pipe, rotative means supported by said body means adapted for rotation coaxially of said pipe, a plurality of brushes circularly spaced around the outer periphery of said rotative means and mounted for rotation about an axis directed toward the wall of the pipe, gas motor means for rotating each said brush about its said axis, said rotative means having flow passage means for delivering gas from a non-rotative source carried by said body means to said gas motor means to operate said gas motor means, said axis of each said brush being disposed at a small forward angle from a direction radially of said rotative means with respect to the direction of rotation of said rotative means whereby the leading edge of each said brush bears against the pipe wall with less pressure than the trailing edge of the brush and thereby reducing brush wear, and including means for biasing each brush toward the pipe wall.

2. The combination of claim 1, each said biasing means comprising at least one compression spring.

3. The combination of claim 1, each said brush being movable longitudinally of its said axis.

4. The combination of claim 3, including means for limiting outward movement of each said brush.

5. The combination of claim 3, including means for limiting inward movement of each said brush.

6. The combination of claim 3, including means for limiting inward and outward movement of each said brush.

7. The combination of claim 6, each said means for limiting outward movement of a said brush being adjustable to compensate for brush wear.

8. Apparatus for brush cleaning the inner side of the wall of a pipe, comprising body means adapted to be received in a pipe, rotative means supported by said body means adapted for rotation coaxially of said pipe, a plurality of brushes circularly spaced around the outer periphery of said rotative means and mounted for rotation about an axis directed toward the wall of the pipe, gas motor means for rotating each said brush about its said axis, said rotative means having flow passage means for delivering gas from a non-rotative source carried by said body means to said gas motor means to operate said gas motor means, said axis of each said brush being disposed at a small forward angle from a direction radially of said rotative means with respect to the direction of rotation of said rotative means whereby the leading edge of each said brush bears against the pipe wall with less pressure than the trailing edge of the brush and thereby reducing brush wear, said rotative means comprising conduit means supported by said body means for concentric rotation about the axis of the pipe, generally circular plate means fixed around said pipe and extending outwardly therefrom toward the pipe wall, said plate means having plural equally circularly spaced slots therearound extending inwardly from its outer periphery, each said gas motor means and brush being disposed in one of said slots and adapted to slide inwardly and outwardly of the slot.

9. The combination of claim 8, each said gas motor means having plural support plate means extending oppositely transversely therefrom, the opposite ends of each said support plate means being slotted to slidably receive said plate means at the opposite sides of the said slot in which the gas motor means is disposed.

10. The combination of claim 9, including means carried by said plate means for engaging a said support plate means for limiting outward movement of said gas motor means and brush.

11. The combination of claim 9, including means carried by said plate means for engaging a said support plate means for limiting inward movement of said gas motor means and brush.

12. The combination of claim 9, including means carried by said plate means for engaging a said support plate means for limiting inward and outward movement of said gas motor means and brush.

13. The combination of claim 12, said means for limiting outward movement of said gas motor means and brush being adjustable to compensate for brush wear.

14. The combination of claim 9, including means for biasing each said gas motor means and brush outwardly toward the pipe wall.

15. The combination of claim 14, each said biasing means comprising at least one compression spring.

16. The combination of claim 9, said flow passage means comprising said conduit means and a flexible conduit extending therefrom to each said gas motor means.

17. The combination of claim 16, including manifold means at an end of said conduit means to which said flexible conduits are connected, the other end of said conduit means being journaled for rotation at a swivel connection carried by said body means to which said gas source is connected.

18. The combination of claim 17, said gas source comprising motor driven gas compressor means carried by said body means.

19. The combination of claim 17, said gas source comprising gas compressor means disposed outside of the pipe, and conduit means extending through the pipe connecting said compressor means to said swivel connection.

20. The combination of claim 19, including means for rotating said rotative means.

21. The combination of claim 19, said body means having wheel means for supporting said body means for rolling movement through the pipe.

22. The combination of claim 21, at least one said wheel means being a driven wheel means.

23. The combination of claim 19, including wiper means around the forward end of said body means, said plate means being disposed forward of said wiper means.

24. The combination of claim 23, including nozzle means carried by said body means forward of said wiper means for flushing material brushed from the inner side of the pipe wall from the pipe.

25. The combination of claim 19, said body means comprising a length of pipe having transverse plate means supporting bearing means at its center for rotatively supporting said rotative means.

26. Apparatus for brush cleaning the inner side of the wall of a pipe, comprising body means adapted to be received in a pipe, rotative means supported by said body means adapted for rotation coaxially of said pipe, a plurality of brushes circularly spaced around the outer periphery of said rotative means and each brush being mounted for rotation about an axis directed toward the wall of the pipe, gas motor means for rotating each said brush about its said axis, and including compression spring means disposed parallel to said axis for biasing each said brush toward the pipe wall.

27. Apparatus for brush cleaning the inner side of the wall of a pipe, comprising body means adapted to be received in a pipe, rotative means supported by said body means adapted for rotation coaxially of said pipe, a plurality of brushes circularly spaced around the outer periphery of said rotative means and each brush being mounted for rotation about an axis directed toward the wall of the pipe, gas motor means for rotating each said brush about its said axis, said rotative means comprising conduit means supported by said body means for concentric rotation about the axis of the pipe, generally circular plate means fixed around said pipe and extending outwardly therefrom toward the pipe wall, said plate means having plural circularly spaced slots therearound extending inwardly from its outer periphery, each said gas motor means and brush being disposed in one of said slots and adapted to slide inwardly and outwardly of the slot.

28. The combination of claim 27, including means for biasing each said gas motor means and brush outwardly of the slot to urge the brush into contact with the pipe wall.

29. The combination of claim 28, including means for limiting the inward and outward movement of each said gas motor means and brush in said slot.

30. The combination of claim 29, said limiting means comprising insert means movably disposed in any of plural openings provided along the radial edges of said slots.

31. The combination of claim 28, said biasing means comprising compression spring means disposed generally parallel to said axis of said brush.

* * * * *